US009586793B2

(12) United States Patent
Prindiville

(10) Patent No.: US 9,586,793 B2
(45) Date of Patent: Mar. 7, 2017

(54) MULTI-PORT VACUUM LIFTING ATTACHMENT WITH REMOTE CONTROLLING RELEASE

(71) Applicant: Michael Prindiville, St. Louis, MO (US)

(72) Inventor: Michael Prindiville, St. Louis, MO (US)

( * ) Notice: Subject to any disclaimer, the term of this patent is extended or adjusted under 35 U.S.C. 154(b) by 0 days.

(21) Appl. No.: 14/998,719

(22) Filed: Feb. 5, 2016

(65) Prior Publication Data

US 2016/0244301 A1 Aug. 25, 2016

Related U.S. Application Data

(60) Provisional application No. 62/176,111, filed on Feb. 9, 2015.

(51) Int. Cl.
*B66C 1/02* (2006.01)

(52) U.S. Cl.
CPC ..... *B66C 1/0243* (2013.01); *B66C 1/0212* (2013.01); *B66C 1/0256* (2013.01)

(58) Field of Classification Search
CPC ..... B66C 1/02; B66C 1/0212; B66C 1/0218; B66C 1/0237; B66C 1/0243; B66C 1/025; B66C 1/0256; B66C 1/0281; B66F 9/181; B25J 15/0616
USPC ... 294/183, 185, 186, 188, 65, 905; 414/627
See application file for complete search history.

(56) References Cited

U.S. PATENT DOCUMENTS

| | | | | |
|---|---|---|---|---|
| 1,294,103 | A | 2/1919 | Hitchcock | |
| 2,916,059 | A | 12/1959 | Wong | |
| 3,055,694 | A * | 9/1962 | Billner | B66C 1/0281 294/65 |
| 3,423,119 | A * | 1/1969 | Stanley | B65G 47/91 294/64.2 |
| 3,578,372 | A * | 5/1971 | Schuler | B66C 1/0218 248/363 |
| 3,743,340 | A | 7/1973 | Williamann | |
| 3,970,341 | A | 7/1976 | Glanemann et al. | |
| 3,973,795 | A * | 8/1976 | Goransson | B66C 1/0243 294/65 |
| 4,091,945 | A | 5/1978 | Patterson | |
| 4,674,785 | A * | 6/1987 | Riesenberg | B25B 11/005 294/186 |
| 5,192,070 | A | 3/1993 | Nagai et al. | |
| 5,752,729 | A * | 5/1998 | Crozier | B66C 1/0218 294/188 |
| 6,213,528 | B1 | 4/2001 | Hufken et al. | |
| 6,502,877 | B2 | 1/2003 | Schick et al. | |
| 8,560,121 | B2 | 10/2013 | Hjornet | |
| 8,613,817 | B2 | 12/2013 | Hirase et al. | |

(Continued)

FOREIGN PATENT DOCUMENTS

WO WO 90/13505 * 11/1990

*Primary Examiner* — Dean Kramer
(74) *Attorney, Agent, or Firm* — Paul M. Denk

(57) ABSTRACT

A multi-port vacuum lifting attachment, with remote controlled release, including a dual port vacuum lifting attachment for use in the concrete and steel industries, the attachment includes flexible seals for each of its suction ports, that creates a tight vacuum seal on smooth steal, and also upon roughened surfaces such as concrete, allowing for the suction attachment of the device to these panels, to attain their lifting, transporting, and releasing, with the aid of the remote controlled release mechanism.

8 Claims, 10 Drawing Sheets

(56) References Cited

U.S. PATENT DOCUMENTS

| | | | |
|---|---|---|---|
| 8,662,862 | B2 | 3/2014 | Muhs |
| 8,783,634 | B2 | 7/2014 | Summers et al. |
| 8,854,813 | B2 | 10/2014 | Bai et al. |
| 8,858,472 | B2 | 10/2014 | Gomez |
| 8,881,339 | B2 | 11/2014 | Gilbert, Jr. et al. |
| 2009/0206619 | A1 | 8/2009 | Schmidt et al. |
| 2010/0183415 | A1* | 7/2010 | Solomon ..... B66C 1/0256 414/627 |
| 2010/0219651 | A1 | 9/2010 | Walter et al. |

* cited by examiner

MULTI-PORT VACUUM LIFTING ATTACHMENT WITH REMOTE CONTROLLING RELEASE

FIELD OF INVENTION

This invention relates primarily to lifting attachments, and more specifically to a more universal type of lifting attachment that can lift substantially heavy panels of concrete, steel, or other forms of slabs, through the use of multi-port vacuum lifting attachments, that creates a tight vacuum seal at multiple locations on the surface of the item to be raised, even through such surface may have roughened characteristics, but yet still allows for attachment, transporting, releasing and removal, with the aid of a remote controlled release mechanism.

BACKGROUND

As stated, this invention relates to lifting attachments. Heretofore, many types of attachments have been readily available for use upon concrete and steel, but moving equipment manufacturers normally design attachments to specifically fit their own equipment, and therefore, cannot be attached for usage with other brands or accessories.

As is known in the art, lifting attachments have been available in the concrete and steel industries for years. Generally, companies know that when lifting heavy pieces of concrete and steel, they need both a heavy item of moving equipment, and an attachment to grab the concrete and steel with, to achieve its movement. Many types of attachments, like buckets, claws, straps and chains, are well known and readily available in the art.

In addition, many other types of attachments have been developed for use with moving concrete slabs and steel panels. Obviously, these types of panels are so heavy, that humans are not capable of physically lilting such. Thus, the attachments are primarily designed for providing mechanical lifting of such slabs, but they require a preshifting or raising of the panels, so that straps may be placed beneath them, to attain any movement, at all. Such attachments are primarily designed for the lifting side of the equation, and secondly, have a tendency of making the releasing side a long and time consuming task.

An example of the foregoing type of lifting device can be seen in the variety of patents or publications that show the use of straps, clamps, or the like, for making physical engagements with such slabs or panels, to attain their lifting. As stated, the problem with these is that the panel must be raised, in order to get a strap or gripping device thereunder, to achieve their lifting.

The use of a claw type mechanism for lifting the concrete slab, while they may be effective for lifting of either concrete or steel, they do not have universal application. Secondly, the transporting of the heavy concrete or steel is dangerous, and can easily fall from their suspension.

Other earlier disclosures show lifting attachments, that may connect to a back hoe bucket, and while this type of device may also be effective in the lifting of concrete or steel, the transportation and releasing is still a very loose and dangerous operation.

There are a variety of vacuum type lifting devices, that have been available either on the market, or disclosed in prior patents or published applications. For example, the prior published application to Walter, et al, No. U.S. 2010/0219651, shows a singular vacuum lifting device and method of use. While this particular device is helpful for lifting smaller-type concrete pavers, one of the problems with it, is that it is of a single vacuum lifting design, and therefore, if a slab or panel has a crack in it, this type of lifting device usually cannot secure therewith, and is ineffective for attaining lifting of that type of impaired heavy panel.

The patent to Gilbert, Jr., et al, U.S. Pat. No. 8,881,339, shows a robotic type of vacuum device. The patent to Muhs, No. U.S. Pat. No. 8,662,862, shows a pump system with vacuum source, which appears to be more of the usage of a vacuum pump for pumping fluids, in the usage of this system. The patent to Mantyla, et al, U.S. Pat. No. 8,613,817, shows a central vacuum inlet valve assembly, for its installation. The patent to Hjornet, U.S. Pat. No. 8,560,121, shows another form of vacuum gripping apparatus, for use for grabbing irregular and deformable work pieces, for lifting purposes. The patent to Gomez, U.S. Pat. No. 8,858,472, shows a lift suction device and related method. Also, the patent to Bai, et al, U.S. Pat. No. 8,854,813, shows an adjustable air suction device. And, the patent to Summers, et al, U.S. Pat. No. 8,783,634, shows another form of suction device, that may be applied to a target surface.

Other types of suction devices can be seen in the suction pad attachment of U.S. Pat. No. 5,192,070, to Nagai, et al. This device is for use for holding a work component.

The patent to Williamann, U.S. Pat. No. 3,743,340, shows an early vacuum lifting device, that incorporates a bellows means, for use for lifting purposes. And, the patent to Schick, et al, U.S. Pat. No. 6,502,877, shows a further gripper system, in particular vacuum gripper system, that incorporates two mutually independent gripper elements, for use for holding to a work surface.

The published application to Schmidt, et al, No. U.S. 2009/0206619, shows another suction gripper device.

The patent to Patterson, U.S. Pat. No. 4,091,945, shows a tile setting apparatus that may be used for securing with a plurality of tiles as they are being applied to a floor or other surface.

The patent to Glanemann, et al, U.S. Pat. No. 3,970,341, shows a further vacuum lifting unit including a suction cup.

The early patent to Hitchcock, U.S. Pat. No. 1,294,103, shows a further early vacuum lifting device.

The patent to Wong, No. U.S. Pat. No. 2,916,059, shows a further evacuation valve cup.

Finally, the patent to Hufken, et al, U.S. Pat. No. 6,213,528, shows the formation of a vacuum cup.

These are examples of the type of lifting attachments for use in a variety of fields, and which perhaps could also be used for lifting concrete and steel products. Most of them are custom made for their own specific machines, and are not of universal design, and none of them were ever designed for a quick release, as is the design for the current invention.

SUMMARY OF THE INVENTION

The invention relates primarily to lifting attachments, but more specifically relates to a more universal type of attachment that not only attaches to every brand of moving equipment, but at the same time, substantially reduces the time and costs, associated with removal, movement and disposal of concrete and steel products, with the benefits of a remote controlled system. As can be easily understood, when concrete needs to be removed, with noisy jackhammers and loud air compressors running, it wakes up babies, the elderly and shift workers, making neighbors very hostile. Hence, the current invention is designed to not only remove the concrete, but to do it without the need, of noisy jackhammers or loud air compressors, while also gently releasing the concrete, substantially reducing, if not eliminating loud disturbing noises to the neighborhood, when using this current invention.

Secondly, this attachment is designed to have universal application and fits every manufacturers make and model. It comes standard with two lifting options. You can either use the four straps with hooks connected to a universal bridle for top mounted lifting, or you can use the universal forklift runners, thereby making it more universal of application, and can be bought as a shelf product, for application and usage upon any manufacturers lifting equipment.

This invention contemplates the formation of a steel casement, having generally rectangular configuration, including a remote control system and flexible seals, which when fully assembled together, incorporates a universal vacuum lifting system, ready to be installed on any manufacturers make or model. In the preferred embodiment, because of the unique structure of this invention, and its ability to virtually eliminate the loud noises associated with concrete removal, angry confrontations from neighbors will be minimized.

The lifting system includes integrally a vacuum system derived from an engine and a vacuum pump, combined with flexible seals, which create the vacuum in the dual chambers/ports, an a remote controlled release. Applicant has found that by inventing a quieter lifting system that can also quietly release the concrete directly into the dump truck beds, instead of dropping the concrete in from the top of the truck, not only saves the bed of the truck/dumpster, but it only makes one-third of the amount of noise. This is what is also embodied into the second attribute of this invention, the ability to substantially reduce the sound generated from concrete removal, while at the same time providing a more universal type of lifting system capable of attaching to every manufacturers make or model. Hence, the benefits derived from this invention are two fold.

It is, therefore, the principal object of this invention to provide a vacuum lifting system with a remote controlled release and flexible seal, which is of uniform construction, that is adaptable of universal design and that can be installed on any manufacturers make or model of moving equipment.

Another object of this invention is to create a flexible seal that can work on rougher surfaces, therein, to increase the efficiency of sealing of the embodiment.

A further object of this invention is to create dual lifting chambers/ports, with a 7' dead area in the middle, to go around cracks in concrete, the designed false joints in sidewalk concrete, as well as lifting holes in street plates.

Still another object of this invention is to provide a remote controlled release, to gently release concrete into dump trucks and dumpsters, greatly reducing the sounds associated with concrete removal, and greatly increasing the longevity of dump truck/dumpster beds.

Yet another object of this invention is to provide a battery, that is installed to provide the electronic connection for the remote controlled release system, and it also provides power for the electric start gas engine.

Still another object of this invention is to provide dual 4' glycerin filled vacuum gauges, to provide clearer viewing of vacuum gauge levels, from either side of the lifting system.

Yet another object of this invention is the dual access lifting options, one can choose from using a universal four leg strap with hooks and a bridle, for strapping it from the top, or from using the universal forklift runners on the bottom side.

A further object of this invention is the dual function of the square tubing used for the frame. The 3"×3" steel tubing frame not only adds strength, it also stores up negative pressure, which is used in the sealing process of the object to be lifted.

Still another object of this invention is to provide a multi-lifter that is multi-functional, for example, while it contains a series and a plurality of vacuum ports, it can actually also be used with a single port to lift any type of heavy item.

Yet another object of this invention is to benefit from the natural safety factor that is inherent and unique to a vacuum system. Should one leg of a conventional chain or lifting strap break, when lifting a piece of concrete or steel, the object will spin out of control before falling to the ground. A vacuum system not only locks the object securely when the engine and vacuum pump is running, but it also keeps the same vacuum lock, even if the engine would stop for any reason. The lock established to make the lift, is still there, until the remote control release is activated. No other attachment has a back tip safety system as a vacuum system has.

This invention has obvious markets such as concrete removal for state, county and municipal public works departments, but it can also move their street plates, manhole covers and sewer lids. When hurricanes and tornadoes happen, this invention will attach to any type of moving equipment, even a simple forklift, to help them quickly remove debris such as washers, dryers, aluminum, plastic and fiberglass pools/spas, separate some cars and boats, pick up concrete removed by tidal surges, etc. Commercial concrete and steel companies/contractors, utility companies, quarries, demolition companies, concrete cutting companies, pre-cast concrete companies, large landscaping companies and even pool companies will all use this invention.

It is still a further object of this invention to provide a multi-lifter device, which is multi-functional, and in the preferred embodiment, can lift up to 3,000 pounds, or much more, of weight, whether it be slabs of concrete, steel plates that are used on street constructions, stackable boulders, pre-cast pavers, concrete benches, concrete picnic tables, metal and concrete trash cans/dumpsters, large concrete planter boxes for streets, granite stair treads, wall croppings, flagstones, exposed aggregate concrete, and many other and more uses as can be imagined.

These and other objects may become more apparent to those skilled in the art upon review of the summary of the invention as provided herein, and upon undertaking a study of the description of its preferred embodiment, in view of the drawings.

DETAILED DESCRIPTION OF PREFERRED EMBODIMENT

Essentially, this invention is designed as a dual-port vacuum lifting attachment that incorporates a remote controlled release means for use in the concrete and steel industries, to facilitate the lifting of heavy slabs and panels, simply through the use of vacuum attachment of this device to the same, without too much manual participation in performance of the process. Thus, minimizing human exposure to the heavy construction aspects of lifting these types of panels minimizes the potential for human error, and resulting injury, which may occur with other prior art types of lifting devices.

Essentially, this invention includes a steel framework, comprising a base plate, incorporating dual suction ports, that have flexible seals on their bottom side, and incorporates steel frame vacuum tubing, an engine, vacuum pump, ball valves, rubber tubing, vacuum gauges, air filters, oil catch mufflers, battery, and the remote controlled release, as stated, which all may be combined together to create a tight vacuum seal even on generally rough surfaces.

Figure 1:
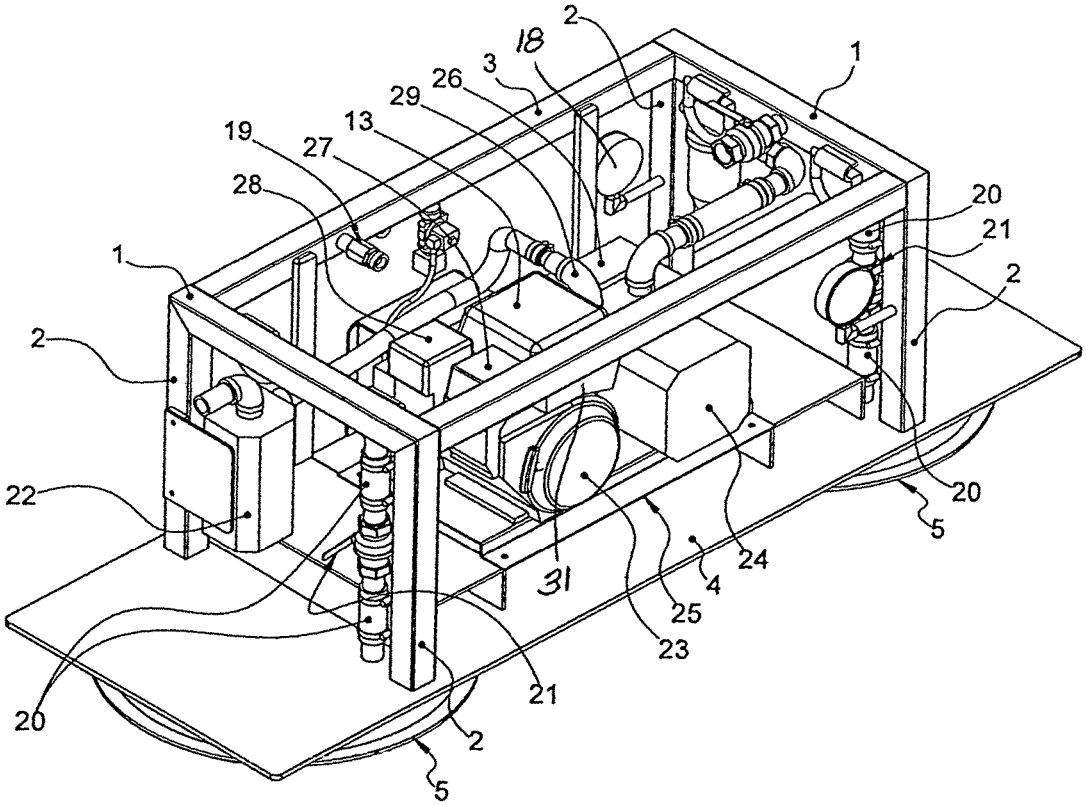
FIG. 1 is a front isometric view of the multi-lifter with pump-engine combination of this system, showing its various operative components.
Figure 2:
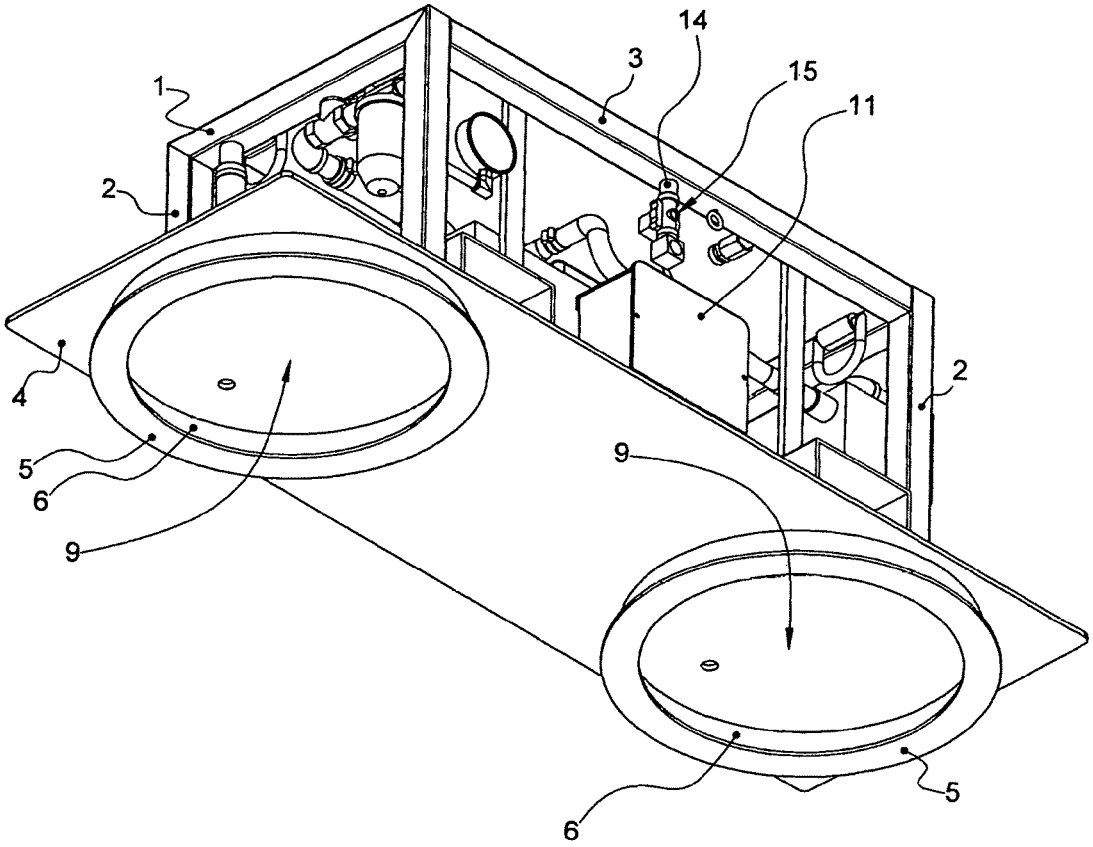
FIG. 2 is a bottom isometric view showing the pair of suction chambers provided to the bottom of the device, and for securing at two separate locations to any slab or plate to be lifted.
Figure 3:
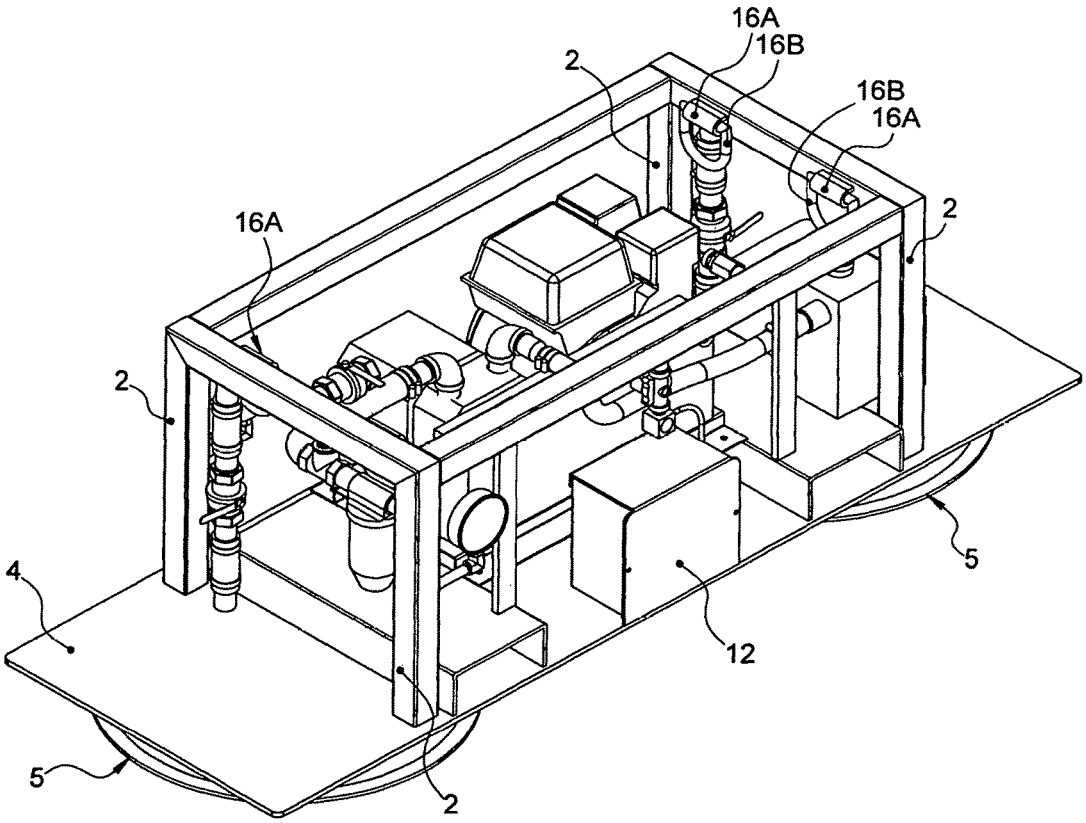
FIG. 3 is a back isometric view of the system of this invention.
Figure 4:
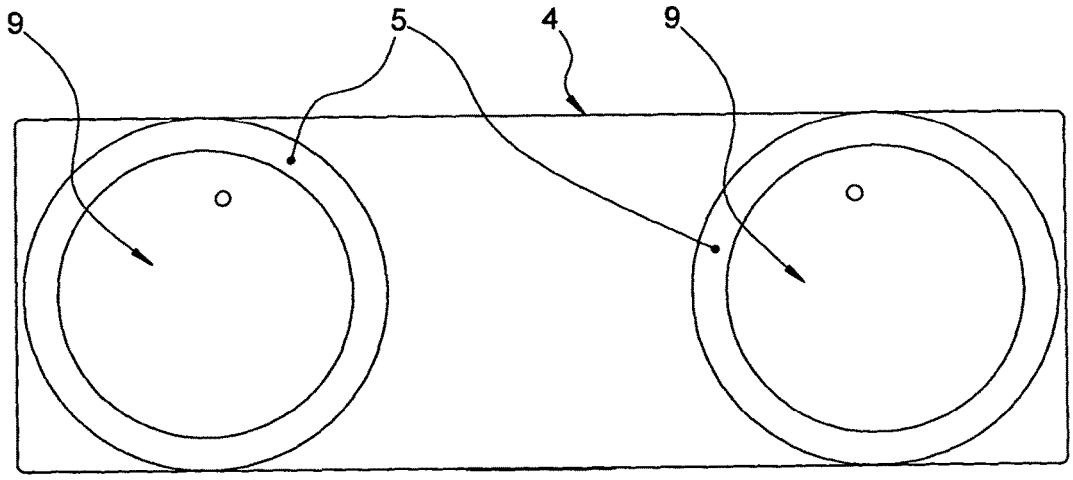
FIG. 4 is a bottom view.
Figure 5:
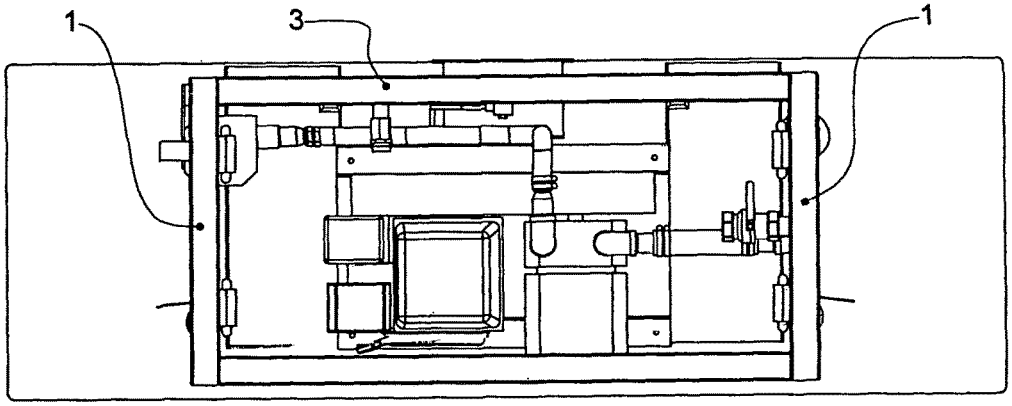
FIG. 5 is a top plan view.
Figure 6:
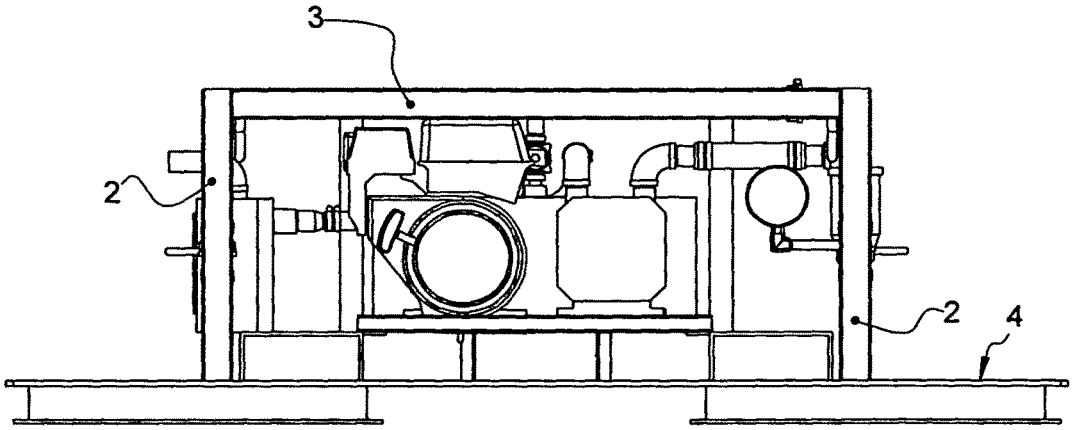
FIG. 6 is a front elevational view.
Figure 7:
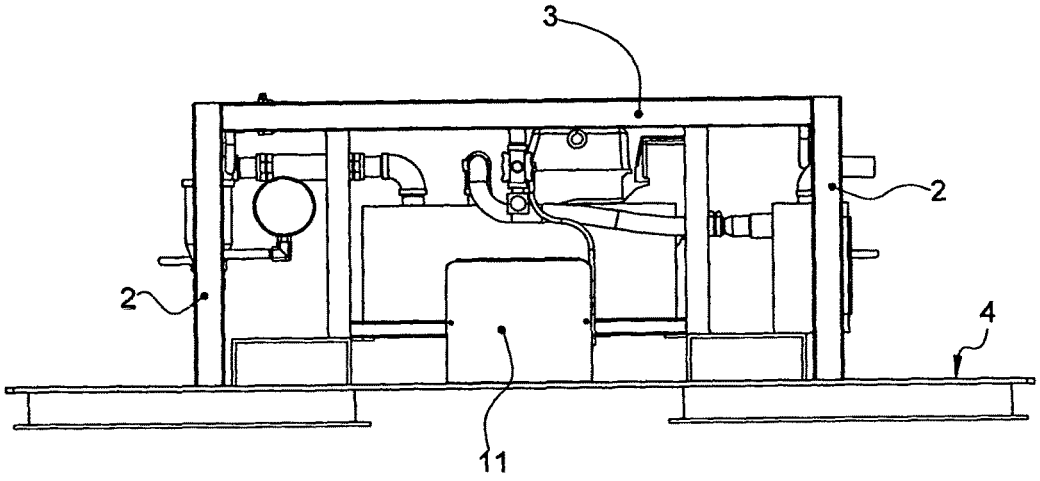
FIG. 7 is a rear elevational view.
Figure 8:
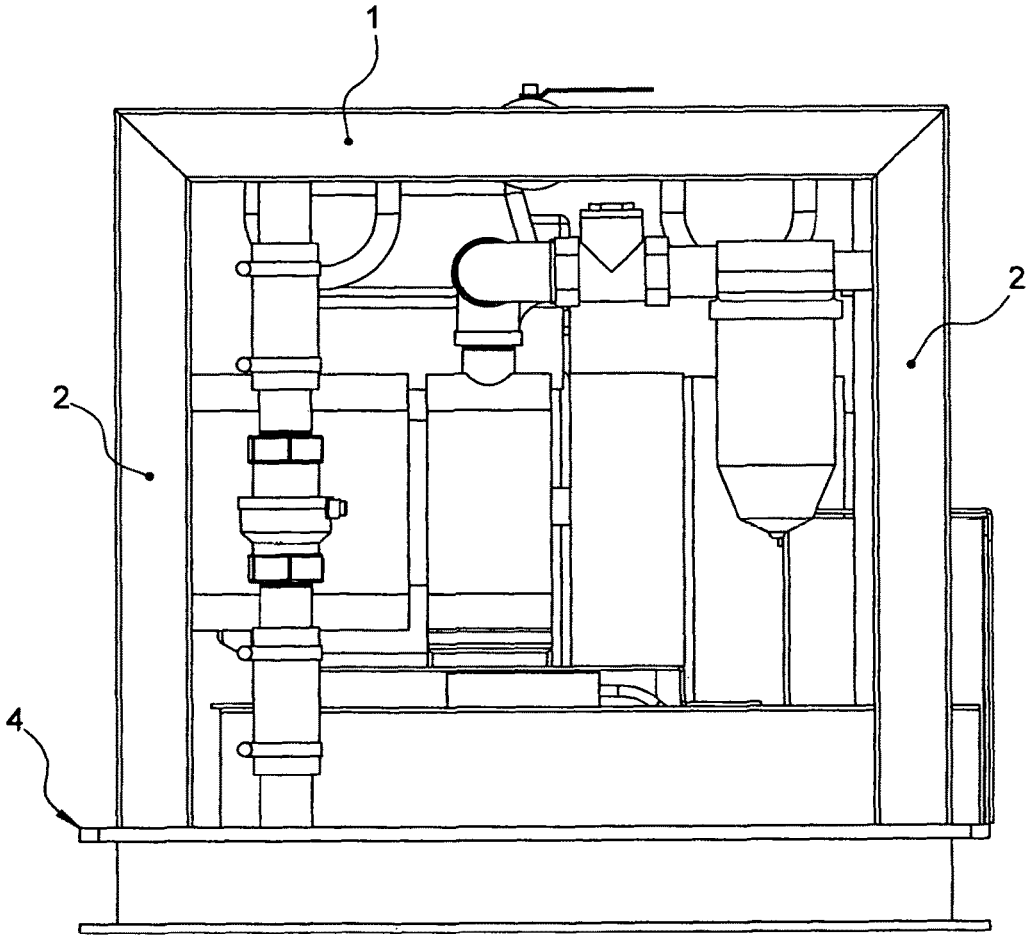
FIG. 8 is a right side view.
Figure 9:
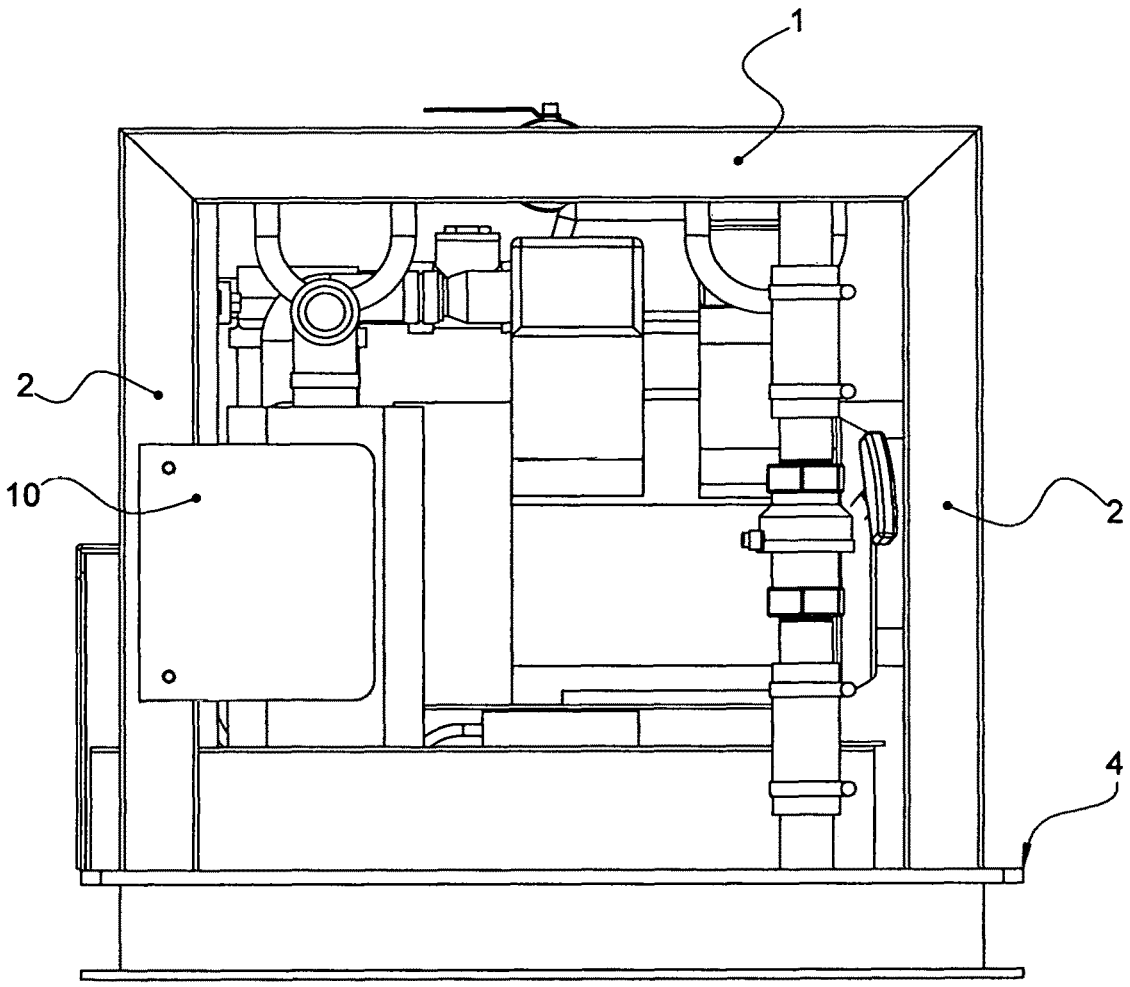
FIG. 9 is a left side view of the system.

In referring to FIGS. 1-3, it can be seen that the framework of this invention includes the top vacuum tubes 1, which have passages through their interior, so that any vacuum generated by this device can be transferred throughout the system by passing it through these various tubular members that make up the framework. The side vacuum conducting tubes 2, are vertically aligned, and communicate with the upper side tubes 1, as can be noted. In addition, there is the back vacuum tube 3 that communicates with all of the other tubes of the framework, so that when a vacuum is generated through operations of the device, it extends through all of the tubular framework, and which eventually is communicated to the dual suction ports and their flexible seals, provided on the bottom side of the device. The framework secures with a base plate 4, as can be noted.

There are a pair of seal rings 5 that are formed connecting with the bottom side of the base plate 4, and these are integrated with the vertical seal walls 6, as can be seen. The seal rings attach to the bottom structural frame of said seal walls 6. The interior bottom of each of the suction ports, as noted at 9, may have a series of ports, generally as can be seen in the U.S. Pat. No. 5,192,070, or each may have a singular opened port, generally as can be noted in U.S. Pat. No. 3,743,340. This will depend upon the uniform distribution of the generated vacuum that may be necessary for lifting either a smooth plate, or a more roughened surface, as can be understood.

The seal rings 5 formed integral with the suction ports 9 may be made of sufficiently flexible polymer, such as ½ inch thick polyolefin, to form the rings that may adhere to the surface of any panel, or even their roughened surface of a concrete slab, to generate that sufficient vacuum necessary to obtain lifting of the heavy load, during usage of this device.

There are other accessories that are formed upon the base plate 4, and structured within its framework, and these include an oil catch mounting plate 10, and further provided is a battery cover 11, that shields the location of the battery therein, and which is useful for starting of the motor, such as the combustion motor 23, as can be noted. Also, 12 shows the back plate for the battery cover.

No. 24 provides the vacuum pump for the device, and it is operated by the electric start engine 23, through a chain drive that interconnects between the two, so that the engine can transmit its rotary power to the pump, for its generation of the necessary heavy vacuum required to obtain lifting of the various panels. No. 25 discloses a base for the engine and the pump, in their mounting upon the frame work and its base plate 4. No. 27 is the electric starter for the gasoline engine 23, and 28 is the engine muffler, for damping the sound during usage of the device. And, 13 is the fill tank, for the gasoline engine, to supply it with fuel during its operations. It might be stated that the engine itself, in the preferred embodiment, is a 5.5. horsepower Honda engine. That vacuum pump 24, is previously explained, is a 35 CFM vacuum generating pump, and is manufactured by Conde.

To further elaborate, the various panels 25 that make up the base for supporting the engine, pump, and other operative components, off of the base plate 4, have other attributes that are provided from their structure. For example, it can be seen that the base frame provided under the vacuum pump 24, provides a rectangular space, and that the base frame under the electric start engine 23, has likewise a spaced relationship with the base plate 4. Hence, the spacing of these frames are at a convenient distance apart, so that a forklift can be located therein, when it is desired to move the lifting attachment to a different location. Furthermore, this provides a convenient spacing between the base plate 4, and the operating components of the engine and vacuum pump, to furnish it with some degree of separation, in order to prevent any impacting force from operating directly upon these components, that may lead to their early breakdown. In addition, it is just as likely that the engine, and the pump, could be mounted upon rubber or related grommets, to furnish a shock absorption means for their mounting upon the base plate and base frame, one again, to separate these operative components from any impacting forces during usage of this lifting attachment.

Further within the structure of this device, is the oil catch and muffler 22, that mounts to one of the side vacuum tubes 2, as can be noted. In addition, 26 provides a back cover and wall support for the engine and pump, and generally conceals its chain drive, that interconnects between the engine and the pump, during operations of this device.

There are series of vacuum gauge pipes, and the like, that are embodied within the structure of this device. As previously explained, the framework is formed of hollow tubes, that can conduct the vacuum throughout the structure, from the vacuum pump, and to the suction ports 9, of the lifting attachment. Generally, the vacuum tubes 14 connect between the vacuum conducting frame work, and secure with the vacuum tubing 20, that conducts the generated vacuum to the suction ports 9 of the device. No. 15 provides a port for a vacuum pressure control, or electronic controlled relief valve, which also connects with the vacuum conducting framework.

Various D ring brackets 16A, held by the supports 16B, are provided connecting with the framework, and to which the strapping may be applied, so that the device can be connected to a high lift, fork lift, or other lifting device, that can lift the multi-port vacuum lifting attachment of this invention, during usage.

No. 18 discloses the vacuum gauge covers for the invention. No. 19 provides the threaded vacuum pipe, that connects with the outlet 29 of the vacuum pump, that transmits the vacuum by way of a hose (not shown) to the vacuum pipe 19, and into the framework as previously described, for generating a vacuum at its suction ports, during operations and usage of this device. The vacuum extends down into and through the vacuum tubing 20, on both sides of the framework, and to each of the vacuum ports 9, as previously described.

No. 21 discloses ball valves, or safety valves, that are connected within the vacuum tubing 20, for safety purposes, and also for remote shutoff of the system.

Figure 10:
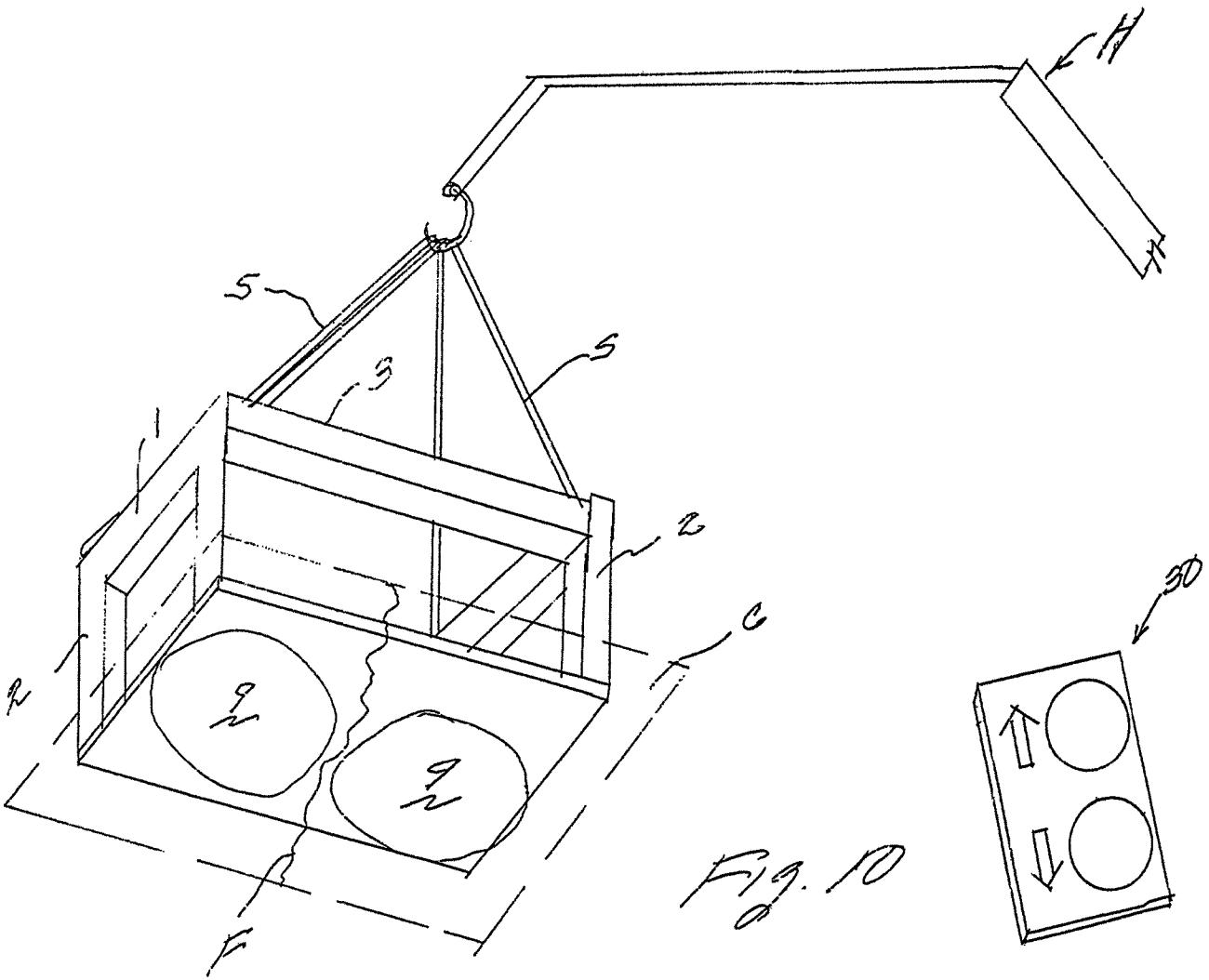
FIG. 10 is an isometric view showing how the system of this invention can be applied to a slab or plate that may have a crack in it, and still lift the same uniformly, and be controlled remotely through the use of a transmitter.

As can be seen in FIG. 10, the multi-port vacuum lifting attachment of this invention, and its various frameworks, as noted, can be seen being elevated by the boom arms of a high lift, or other equipment, as noted at H, with the lifting attachment being suspended by a series of straps S, or cables or chains, to the high lift, as at its ring 16*a*. Thus, it is through this type of equipment that the lifting attachment of this invention can be secured, and almost any type of equipment that is capable of being attached with a strap, etc., can be used to elevate the lifting attachment of this invention. And, it can be seen that the lifting attachment of this invention is elevating a slab, perhaps of concrete, as noted at C, and it can be seen that the concrete slab has a line of fracture, as at F, provided upon its length, as at its rings 16*a*. Thus, the suction ports 9 of this invention can straddle such a fracture, and adhere to two distinct locations upon the slab, and can lift it, without completing the breakage, as the slab is being removed for disposal.

Additionally, as can be noted in FIG. 10, the entire operation of this device can be regulated remotely, through a remote control mechanism 30, as can be seen. Hence, the remote control may contain a transmitter, which may help control the high lift in the elevation of the slab, and its lifting attachment, but also, once the slab has been relocated to its desired location, or onto the bed of a truck, the remote control 30 can also be actuated for controlling a relief valve, such as a relief valve 21, so as to immediately curtail the vacuum, and allow the suction ports to deposit the slab at its desired location. Or, the remote control 30 may send a signal to a receiver, or insulated electronic controller 31, such as either upon the vacuum pump 24, or the engine 23, or on any other of the attachment structures, to curtail their operations, and immediately eliminate the continuing vacuum of pressure within the framework, that allows for release of the slab or held panel, from the vacuum ports 9 of the attachment. This is an example as to how the structure of this device can conveniently be controlled remotely, so as to move the operators away from the heavy loads being shifted, and not be subjected to any injury or death, in the event that there is a premature release of the slab, or something happens that drops the lifting attachment, from its boom arm, of the high lift, or other piece of equipment. The electronic controls and the remote control can be used by the operator of the equipment from within the cab for full operation of the lifting attachment of this invention. Obviously, the electronic controls 31 can operate both the initiation, operations, or curtailment thereof, of the lifting attachment, and all this can be controlled remotely, through the operations of the remote control 30.

While the structure of this invention has been described basically as a multi-port vacuum lifting attachment, and while it does disclose, in its preferred embodiment, a pair of suction port lifting devices, generally, during routine usage, both of the suction ports will be operative, to aid in lifting any heavy structure, such as a concrete slab, metal panel, or any of the other devices that can be lifted through the use of this invention. On the other hand, where the items to be lifted are smaller, such as a manhole cover, sewer lid, or even concrete pavers, it is just as likely that only one of the suction ports may be actuated, and rendered operative, for lifting these smaller, but heavy, type of components, during usage of this lifting attachment.

Other views of the lift attachment can be seen in FIGS. 4 through 9.

During operations, this multi-port vacuum device can generate a suction upon the slab or panel surfaces at a vacuum as low as 18 inches of mercury, or up to as high as 26 inches of mercury, in order to raise such heavy weight panels and allow for there removal and shifting to a different location, or onto a truck bed, as previously explained, for disposal. This can entirely be done without the need for any manual participation, other than the operator of the high lift equipment, and perhaps one other worker that simply guides the device over the panel or slab, to be moved.

Variations or modifications to the subject matter of this invention may occur to those skilled in the art upon review of the summary of the invention as provided herein, and upon undertaking a study of the description of its preferred embodiment, in view of the drawings. Such variations, if within the spirit of this invention, are intended to be encompassed within the scope of any claims to patent protection issuing hereon. The definition of the invention in the preferred embodiment, and it's depiction in the drawings, are set forth for illustrative purposes only.

I claim:

1. A multi-port vacuum lifting attachment incorporating a base plate, a framework mounted upon said base plate, said framework being formed of hollow tubing that provides a conduit for transfer of any vacuum generated within the attachment during its usage, said framework including a series of top tubes that form an upper rectangular framework, a series of side vertical tubes one at each corner connecting with the upper framework at its corners, and said side vertical tubes securing at their lower ends with said base plate, all of said top series of tubes and said series of vertical tubes being hollow and in communication with each other to transfer vacuum generated by said attachment to be transferred throughout said framework, said attachment including an engine provided upon its base plate, a vacuum pump interconnected with the engine and which when operative generating a substantial vacuum for transfer through the series of tubes of the framework, a pair of suction ports provided to the underside of the base plate, said pair of suction ports in communication with the series of tubes forming said framework, each suction port having a sealing ring around its periphery that can seal upon any concrete slab or metal panel to which it may vacuum attach, to achieve their movement, and said multi-port vacuum lifting attachment capable of attachment to a slab at least at two locations, and capable of straddling any imperfection upon such slab or panel that would otherwise prevent the vacuum attraction and holding by the suction ports thereto during usage and operation of this lifting attachment.

2. The multi-port vacuum lifting attachment of claim 1, wherein said vacuum pump communicates by a vacuum line with the frame work for the attachment, and communicates the generated vacuum through the attachment framework and to its multi-suction ports for connection with any panel or slab to be moved.

3. The multi-port vacuum lifting attachment of claim 2, and including a remote control release mechanism operatively associated with the vacuum pump, and upon actuation, curtailing the further generation and release of any vacuum pressure, and allowing any retained slab or panel to be released, after its movement.

4. The multi-port vacuum lifting attachment of claim 3, and including an electronic control package provided upon the attachment and which is responsive to the operations of the remote control to provide for the movement and application of said lifting attachment during its usage.

5. The multi-port vacuum lifting attachment of claim 2 and including a remotely controlled release valve connecting with the framework to allow for the remote release of the vacuum at the completion of a lifting operation.

6. The multi-port vacuum lifting attachment of claim 1 and including a series of connectors attaching with the framework to provide for connection with any strap or chain to provide for the lifting of the attachment during its maneuvering and usage.

7. The multi-port vacuum lifting attachment of claim 1, wherein a pair of spacings are provided with a said base plate to provide clearance for the application of a forklift for transfer of the lifting attachment during its usage.

8. The multi-port vacuum lifting attachment of claim 1 wherein there are at least a pair of suction ports provided to the underside of the base plate.

* * * * *